United States Patent [19]

Kahn et al.

[11] 3,980,371

[45] Sept. 14, 1976

[54] SAFETY ELECTRICAL OUTLET

[75] Inventors: Bernard I. Kahn, Cypress; Donald Dodge, Long Beach; Ernest W. Dietz, Torrance, all of Calif.

[73] Assignee: Pacific Electricord, Gardena, Calif.

[22] Filed: Nov. 3, 1975

[21] Appl. No.: 628,418

Related U.S. Application Data

[63] Continuation-in-part of Ser. No. 550,427, Feb. 18, 1975, abandoned.

[52] U.S. Cl. ..... 339/40

[51] Int. Cl.[2] ..... H01R 13/44

[58] Field of Search ..... 339/40–42; 174/66, 67

[56] References Cited

UNITED STATES PATENTS

| | | | |
|---|---|---|---|
| 2,477,803 | 8/1949 | Huber | 339/40 |
| 2,710,382 | 6/1955 | Fitzpatrick et al. | 339/40 |
| 2,820,842 | 1/1958 | Melstrell | 339/40 X |
| 3,068,442 | 12/1962 | Kubik et al. | 174/67 X |
| 3,810,070 | 5/1974 | Ludwig | 174/67 X |
| 3,865,456 | 2/1975 | Dola | 339/40 |

*Primary Examiner*—Joseph H. McGlynn
*Assistant Examiner*—Craig R. Feinberg
*Attorney, Agent, or Firm*—Fulwider, Patton, Rieber, Lee & Utecht

[57] ABSTRACT

There is disclosed a safety electrical outlet which is provided with a sliding, protective plate that overlies the prong-receiving slots of the outlet and is spring-biased to an offset position barring direct access to receiving slots. The invention is particularly adapted for cube taps of electrical connecting cords which generally comprise bodies of molded plastics in which are embedded parallel conductor strips having prong contactors such as prong-receiving slits which are aligned with the prong-receiving slots of the body. As applied to this construction, all, or all except one, of the pairs of prong-receiving slots are protected by an overlying plate. The protective and overlying plate bears a pair of prong-receiving, parallel, through slots and resilient means in the form of a bifurcated spring member having one leg attached to the plate and its bight and remaining leg seated within a central cavity of the cube tap. The plate and spring can be a one-piece, molded construction of a suitable fatigue-resistant plastic or the spring can be a separate metallic element.

12 Claims, 16 Drawing Figures

SAFETY ELECTRICAL OUTLET

CROSS REFERENCE TO RELATED APPLICATIONS

This application is a continuation-in-part of our copending parent application, Ser. No. 550,427, filed on Feb. 18, 1975, now abandoned.

BACKGROUND OF THE INVENTION

1. Field of Invention

This invention relates to safety electrical outlets and, in particular, relates to cube taps having a protective plate member.

2. Description of the Prior Art

The increasing concern for child safety has let to a recent safety requirement for cube taps of electrical cords. The requirement is that all, or all but one, of the pairs of prong-receiving slots of the cube taps be shielded or protected by a cover plate and the like. A number of devices have been devised for satisfying this requirement including snap-on devices which are attached to the cord or the body of the cube tap. A development which has recently been marketed comprises a plate that is pivotally mounted on the body of the cube tap and that has a pair of parallel through openings to register with the prong-receiving slots of the cube tap. This plate must be rotated by the user to move its through openings into and out of registration with the slots of the cube taps. While this approach does provide protection of the cube tap slots, its successful application requires that the user rotate the plate to move its through openings out of registration with the cube tap slots when disconnecting a cord or appliance from the cube tap. Human fallacy insures that even with this approach, the unused slots of the cube taps will not always be protected. Connectors similar in construction are shown in U.S. Pat. Nos. 1,938,039 and 3,663,924. Similar rotatable protective plate members have been provided on the electrical outlets for wall receptacles such as shown in U.S. Pat. Nos. 2,507,654; 2,559,151; 1,159,207 and 2,119,428.

The aforedescribed approaches have employed relatively complex construction with a multitude of components. It is, therefore, desirable to provide a simple construction having a minimum of component parts that can be readily manufactured and assembled.

BRIEF DESCRIPTION OF THE INVENTION

This invention comprises a safety electrical connector preferably of the cube tap type. The electrical connector is provided with a protective plate which overlies the prong-receiving slots of the connector and which has a pair of parallel, through openings that are biased out of registration with the prong-receiving slots by resilient means which can be of integral, one-piece construction with the plate or can be a separate metallic spring element.

The electrical connector generally comprises a body having at least one pair of parallel, prong-receiving slots in a surface thereof, and parallel electrical contacts in the form of conductor strips bearing prong contactors mounted within the body, one contactor each associated with a prong-receiving slot. The body is provided with a cavity, also open to the surface, centrally positioned between the parallel slots. The protective plate member is carried on the body overlying the prong-receiving slots and bears resilient means in the form of a bifurcated spring member projection from its undersurface with its bight and free leg seated within the central cavity of the body. This member biases the plate to one side of the body with its through openings out of alignment with the prong-receiving slots of the body.

Preferably, the surface of the body is slotted to provide a keyway for mounting of the protective plate member. The cube tap can have all of its pairs of prong-receiving slots protected by protective plate members. Preferably, all but one of the pairs of prong-receiving slots are so protected. In the most preferred embodiment, the surface aperture to the central cavity is of slightly lesser dimensions than the cavity so as to provide an overlying lip which serves as a detent to secure the free end of the bifurcated spring member, thereby retaining the assembly of protective plate and body.

BRIEF DESCRIPTION OF THE DRAWINGS

The invention will be described by reference to the figures of which.

DESCRIPTION OF PREFERRED EMBODIMENTS

Figure 1:
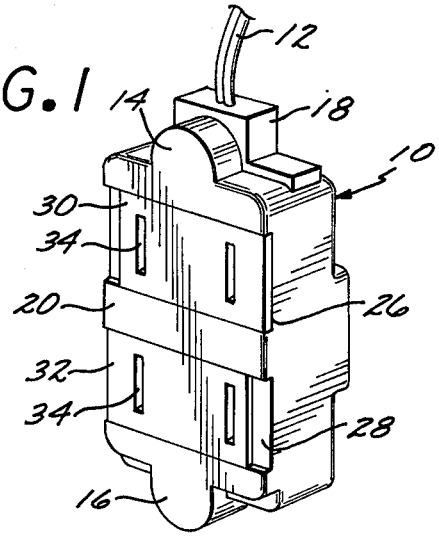
FIGS. 1 and 2 are perspective views of opposite sides of an electrical cube tap embodying the invention.
Figure 2:
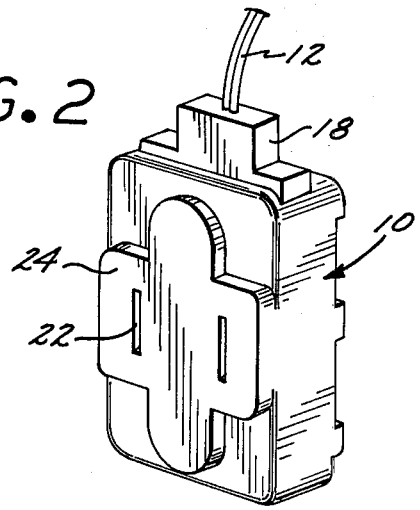

The invention is illustrated in FIGS. 1–9 as applied to a cube tap for an electrical connecting cord. The cube tap comprises body 10 of molded plastic construction which is carried at the end of a conventional electrical cord 12. The body 10 has a generally flat, rectangular configuration with semi-circular bosses 14 and 16 at opposite ends thereof to serve as abutments for the circular, ground prong of three-wire connectors to prevent interchangability of three and two cord connectors. Cord 12 exits from body 10 through a generally square-shanked protuberance 18.

The particular cube tap illustrated in FIGS. 1–4 has three sets of parallel, prong-receiving slots. These are illustrated as two pairs of prong-receiving slots on the exposed face 20 shown in FIG. 1 and a third pair of slots 22 shown on the opposite face 24 illustrated in FIG. 2.

Surface 20 of body 10 is grooved at 26 and 28 to provide two, wide and generally parallel grooves which function as keyways for the reciprocally mounted plates 30 and 32. Each of plates 30 and 32 has a pair of parallel, through openings 34 which are spaced to receive the prongs of a conventional electrical plug connector. These plates, as described hereinafter, are mounted on body 10 with resilient means biasing through openings 34 out of registration with the underlying, prong-receiving slots in body 10.

Figure 3:
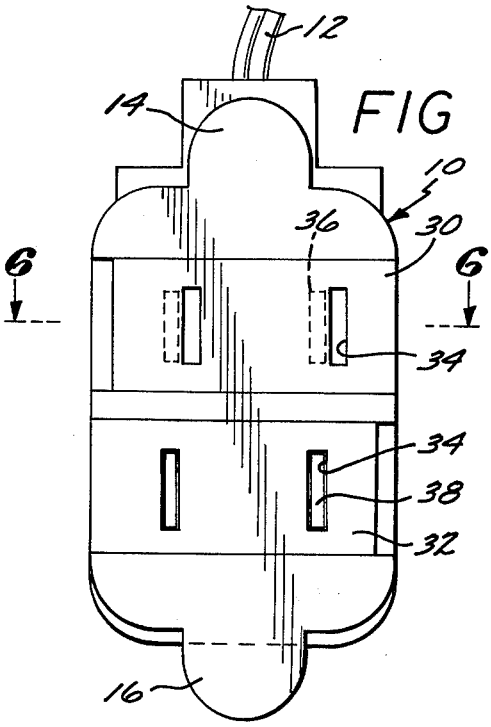
FIG. 3 is a front view of the electrical cube tap.

FIG. 3 illustrates face 20 of the cube tap with the upper plate 30 in its normal position wherein through openings 34 of plate 30 are out of registration with the underlying prong-receiving slots 36. The lower plate 32 is illustrated shifted into a position wherein its through openings 34 are in alignment with the slots 38 to receive the prongs of an electrical plug connector.

Figure 4:
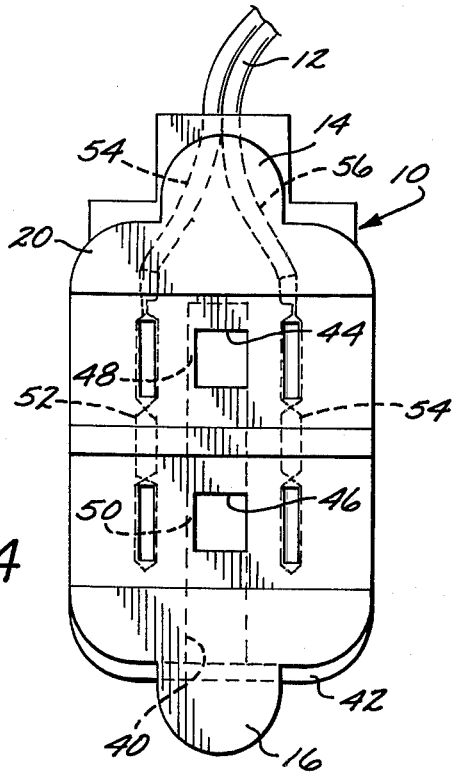
FIG. 4 is a view of the front surface of the cube tap with the protective plates removed.
Figure 5:
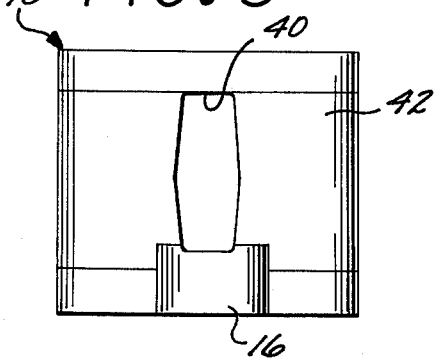
FIG. 5 is an end view of the cube tap.

FIG. 4 illustrates the surface 20 of body 10 with the protective plates 30 and 32 removed. The pairs of prong-receiving slots 36 and 38 are centered on the longitudinal center line of body 10. There is also provided in body 10 a central cavity 40 which extends from end 42 of body 10 longitudinally along the center line of this body. The surface 20 is provided with through apertures 44 and 46 which are centrally positioned between each pair of prong-receiving slots 36 and 38. Preferably, this construction provides apertures which are of slightly lesser width than the width of longitudinal cavity 40 whereby lips 48 and 50 are formed between the cavity and these apertures. The shape and arrangement of the central cavity 40 is better illustrated in FIG 5 whereby the opening can be seen to comprise a generally rectangular slot 40 extending from end 42 of the body 10. This slot is formed in the process of molding body 10 by a center core of the mold.

The cube tap also contains a pair of parallel conductor strips which are embedded within body 10. These electrical conductor strips bear prong-receiving slits, one each associated with each of the prong-receiving slots in body 10 and are mounted in body 10 to locate each slit about its respective prong-receiving slot. These conductor strips are carried at the inboard ends of the wire conductors within electrical cord 12 in the conventional fashion. The conductor strips are shown in broken lines in FIG. 4 as strips 52 and 54, each being formed with three prong-receiving slits which are associated with the three sets of prong-receiving slots 22, 36 and 38 of body 10. Conductor strips 52 and 54 are carried on the ends of the individual wires or cables 54 and 56 of the electrical cord 12. A more complete description of these conductor strips, their manner of construction and assembly in the cube tap can be found in U.S. Pat. No. 3,439,315 of Apr. 15, 1969.

Figure 6:
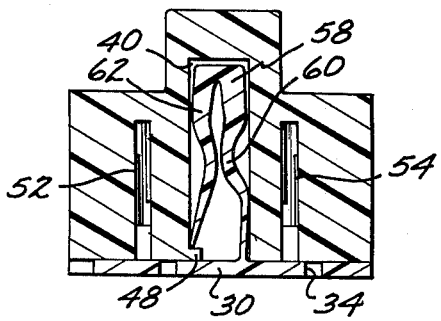
FIGS. 6 and 7 are views along lines 6—6 of FIG. 3 showing different positions of a protective plate.

FIG. 6 is a sectional view along lines 6—6 of FIG. 3. In this view, plate 30 is illustrated with its through openings 34 out of registration with prong-receiving slots 36 in body 10 and the slits of conductors 54 and 52 can be seen to be in prong-receiving positions about slots 36 of body 10. The plate 30 bears on its inside surface, resilient means in the form of a bifurcated spring member 58 which has one leg 60 secured to plate 30 and its opposite leg 62 terminating within cavity 40 of body 10 and beneath lip 48. This lip 48 thereby serves as a detent, preventing egress of spring member 58 from cavity 40 and securing the assembly of plate 30 and spring member 58 to body 10. As shown in FIG. 6, the resiliency of spring member 58 biases plate 30 to the right side of body 10 whereby through openings 34 are out of registration with prong-receiving slots 36.

Figure 7:
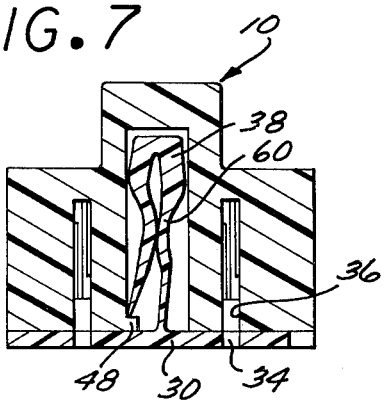

Referring now to FIG. 7, the plate 30 is illustrated on body 10 in a deflected position whereby through openings 34 are in alignment with prong-receiving slots 36 of body 10. In this position the spring member 58 is compressd laterally with its arm 60 deflected as illustrated to accommodate the slight deflection necessary for alignment of through openings 34 and slots 36.

Figure 8:
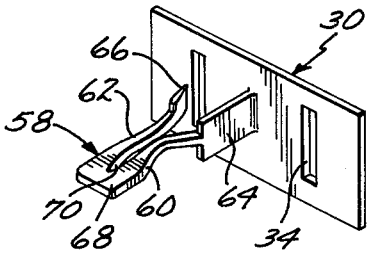
FIG. 8 is a perspective view of a protective plate and its integral resilient means.

FIG. 8 illustrates the one-piece, integral construction of plate 30 and spring member 58. Plate 30 bears spring member 58 as an integral projection from its inside surface. To this end, plate 30 bears a generally rectangular wing projection 64 which is integral with leg 60 of the bifurcated spring member 58. The opposite leg 62 of this member has a generally flat blade 66 at its free end for engagement beneath lip 48 in the central cavity 40 of the body 10.

The plate 30 and spring member 58 can be molded of single-piece plastics construction and any suitable plastic having a high strength, stability and creep resistance can be employed. A preferred material for construction of of this member is an acetal copolymer based on trioxane which is marketed under the brand name "Celcon" by Celanese Plastic Corporation. This material has an excellent long-term creep resistance and a high tensil strength which remains constant over prolonged periods of time. Additionally, the material has a high-fatigue strength and, accordingly, is ideally suited for the formation of the protective plate and integral resilient member 58. In the construction of this member 58, it is preferred to form the inside of bight 68 of member 58 with a smooth radius of curvature generally indicated at 70 to avoid any potential notch failure of the member at this point.

Figure 9:
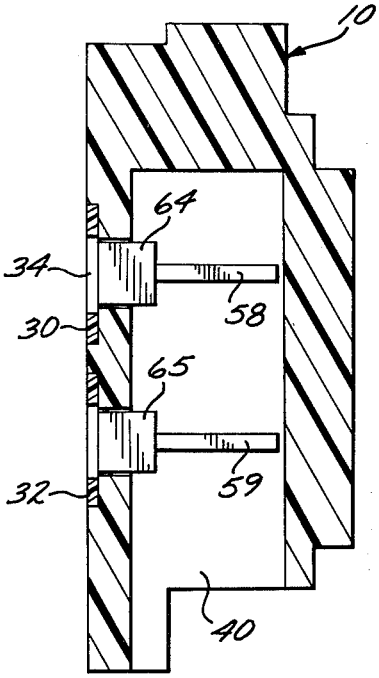
FIG. 9 is a side sectional view of the cube tap with two protective plates in place.

FIG. 9 is a longitudinal cross-section of the cube tap with protective plates 30 and 32 mounted in cavity 40. As illustrated, the bifurcated spring members 58 and 59 of plates 30 and 32 project into cavity 40.

The invention as described can be applied to an electrical cube tap with a minimum of design changes and a minimum of assembly steps. The spring member 58 utilizes the body slot 40 which is present in molded cube taps and the only changes in the cube tap body 10 are apertures 44 and 46 and keyways 26 and 28. Similarly, each protective plate is integral with its spring member and need only be snapped in place, greatly facilitating assembly.

Figure 10:
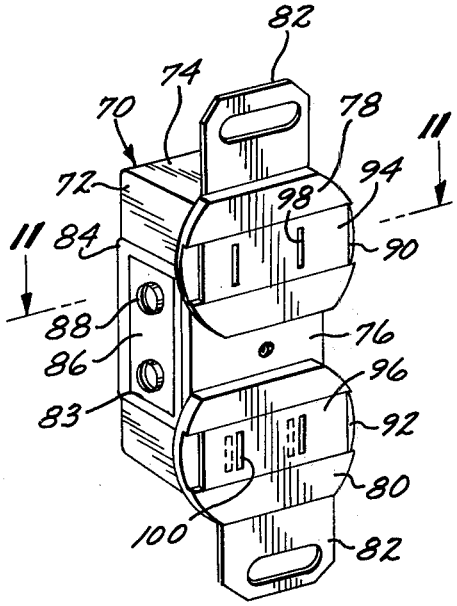
FIG. 10 illustrates use of the protective plates on a typical wall socket outlet fixture.

The invention can also be applied to a typical wall outlet receptacle which includes a connector generally depicted in FIG. 10. The connector is formed with a housing 70 of generally box construction with side walls 72 and end walls 74 which are covered by plate 76 which bears receptacle plates 78 and 80. Also secured in the assembly is the mounting bracket in the form of metallic plate 82 which extends from opposite ends of the assembly. The side walls of the body 70 have a central notch 83 that is surrounded by a raised shoulder 84. The central portion 86 of a connector strip is mounted in the notch 83 and this portion 86 bears a plurality of screw fasteners 88 for the attachment of electrical connectors to complete the electrical connection to the interior of housing 70.

As applied to this invention, the receptacle plates 78 and 80 are provided with transverse keyways 90 and 92 for the mounting of the sliding protective plates 94 and 96. These plates, as those previously described, bear through openings 98 and 100 for receiving the prongs of conventional electrical connectors.

Figure 11:
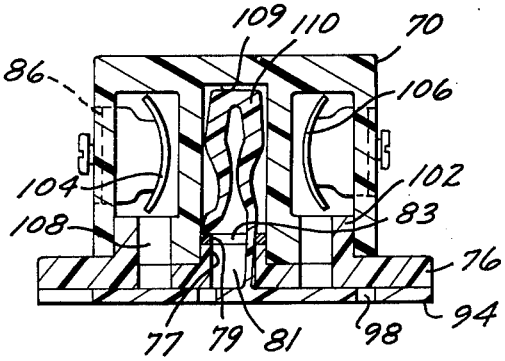
FIGS. 11 and 12 are views along line 11—11 of FIG. 10 illustrating a protective plate member in its normal and deflected positions.

Referring now to FIG. 11, the construction of the receptacle member can be seen in greater detail. As illustrated, housing 70 is closed by plate 76 which has an inset shoulder portion 102 that mounts within the confines of housing 70. The assembly of housing 70 and plate 76 is secured by one or more fasteners which typically are press-fitted into receiving bores in the plate 76. The housing 70 contains a pair of parallel conductor strips 104 and 106 which are projections from each end of central portion 86 previously discussed. These ends are contured into inwardly convex contactors which are positioned immediately beneath the prong-receiving slots 108 in plate 76. The plate 76 bears an inward boss 77 and a metal bar 79 is seated beneath this boss. The bar 79 interconnects end brackets 82. This assembly is modified to accept the resilient spring and cover plate of the invention by forming a deep cavity 109 in housing 70 and forming an elongated slots 81 and 83 in boss 77 and bar 79, respectively. These slots are of sufficient width to permit bifurcated spring member 110 to be inserted into the cavity 109 and then turned 90° into the illustrated position.

The protective plate 94 is similar in construction to that previously described and illustrated in FIG. 8 and bears a pair of generally parallel through openings 98 which are of the proper spacing and dimensions to receive the prongs of a conventional electrical connector. These through openings 98 are normally maintained out of registration with prong-receiving slots 108 in plate 76 in the manner illustrated in FIG. 11. The integral bifurcated spring member 110 resiliently biases plate 94 in the illustrated position to retain through openings 98 out of registration with prong-receiving slots 108.

Figure 12:
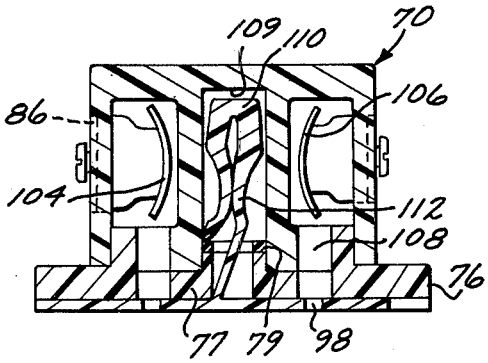
Figure 13:
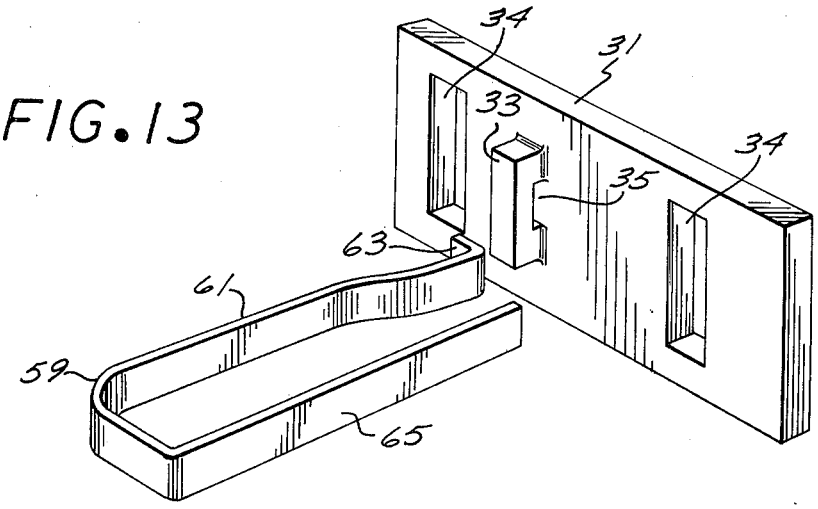
FIGS. 13–16 illustrate the invention using a metallic spring member as the resilient means for the protective plate.

FIG. 12 illustrates the protective plate 94 moved into the prong-receiving position. In this position the bifurcated spring 110 is resiliently deflected, closing the bight of this member and deflecting leg 112 sufficiently to permit through openings 98 to be positioned opposite the prong-receiving slots 108 in plate 76.

Referring now to FIGS. 13 through 16, there is shown a safety electrical connector of the cube tap type having a resilient means which is formed of a separate metallic spring member which is secured to the protective plate. As there illustrated, the protective plate 31 is generally similar to plate 30, previously described and bears a pair of parallel, through openings 34 that are spaced to receive the prongs of a conventional plug connector. The undersurface of plate 31 bears an integral abutment 33 which has a groove 35 to provide a notch for receiving the secured end of the resilient means. The resilient means for biasing plate 31 into its offset position of the cube tap comprises a spring member 59 having a leg 61 with a distal lip 63 for seating in groove 35 of abutment 33. Spring member 59 is a generally bifurcated element with an opposite leg 65.

Figure 14:
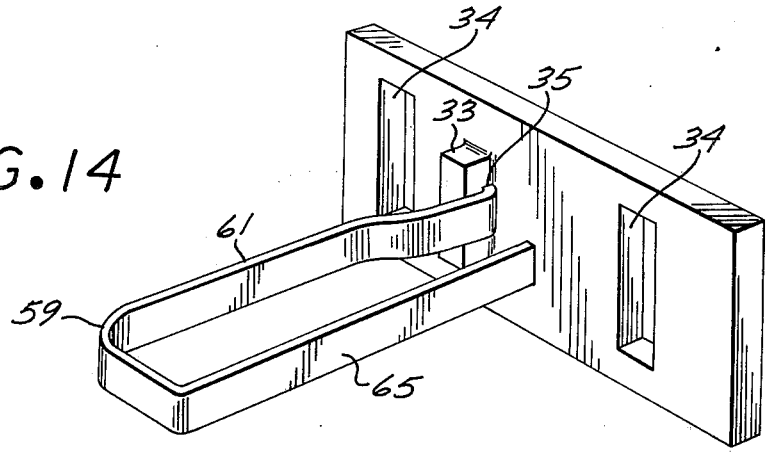

The spring member 59 is secured to plate 31 in the manner illustrated in FIG. 14 with the distal lip 63 seated within groove 35. Groove 35 can be slightly undersized for lip 63 so that the assembly can be secured by a press fit of the lip 63 in the groove 35 or can be slip fit if groove 35 is made larger. In this position, the leg 61 of spring member 59 is firmly secured to the undersurface of protective plate 31 with the opposite leg 65 free for resilient movement and free of engagement with plate 31 to permit it to become restrained under lip 48 as hereinafter described to prevent removal of plate 31 and spring member 59.

Figure 15:
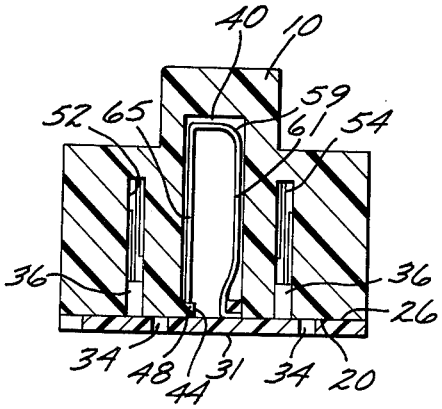

The assembly of spring member 59 and protective plate 31 is mounted on a cube tap such as previously described with regard to FIGS. 1 through 9. as shown in FIG. 15, the cube tap has a body 10 with a pair of spaced-apart conductor strips 52 and 54 which, as previously described, bear slits in prong-receiving positions about slots 36 of body 10. The forward face 20 of body 10 is grooved at 26 to provide a keyway for the reciprocally mounted plate 31. The central, longitudinal cavity 40 in body 10 is open to surface 20 by an aperture 44 between a pair of prong-receiving slots 36. As previously mentioned, the aperture 44 is of slightly lesser width than longitudinal cavity 40 whereby a lip 48 is formed between the cavity and the aperture 44.

Plate 31 with the preassembled spring member 59 is secured to body 10 by inserting the bight end of spring member 59 into aperture 44 and advancing the spring member sufficiently until free leg 65 of this spring member snaps behind lip 48 whereby lip 48 serves a detent, preventing egress of spring member 59 from cavity 40. In this assembly, plate 31 is secured in transverse groove 26 on face 20 of body 10 and the resilient spring member will bias plate 31 to move through openings 34 out of registration with prong-receiving slots 36.

Figure 16:
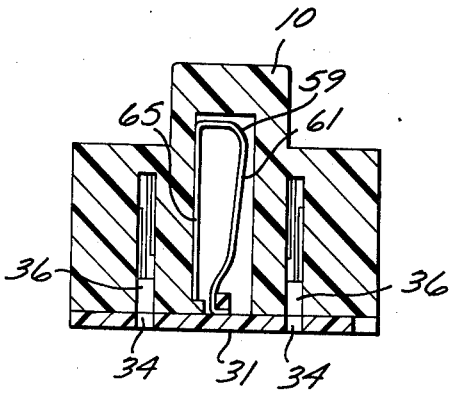

Referring now to FIG. 16, the plate 31 can be seen to be in a deflected position on body 10 whereby through openings 34 are in alignment with prong-receiving slots 36. In this position spring member 59 is compressed laterally with its arm 61 deflected the necessary amount to permit the required lateral travel of plate 31 to attain registration of openings 34 and slots 36.

The invention as illustrated in FIGS. 13–16 can utilize conventional metallic spring members as the resilient means for biasing the protective plate into its offset position shown in FIG. 15. These metallic spring members have adequate fatigue resistance to insure a substantially failure-proof construction. The superior fatigue resistance of the metallic spring members may more than offset the increased cost that can be experienced in the assembly of the metallic spring elements to the protective cover plate.

The invention has been described with reference to the presently preferred and illustrated modes of embodiment thereof. It is not intended by this illustration and description that the invention be unduly limited to the illustration and preferred modes of practice. Instead, it is intended that the invention be defined by the means and their obvious equivalents set forth in the following claims.

What is claimed is:

1. An electrical connector for receiving a prong type connector plug comprising:

a body bearing at least one pair of parallel, prong-receiving slots in a surface thereof;

parallel electrical contacts in the form of conductor strips mounted within said body and bearing prong-receiving slits, one each associated in a prong-receiving position with each of said slots;

a cavity in said body open to said surface, centrally positioned between said parallel slots;

a protective plate overlying said surface and bearing a pair of prong-receiving, parallel through openings; and resilient means in the form of bifurcated spring member having one leg thereof attached to said protective plate and its bight and remaining leg seated within said cavity to bias said protective plate to one side of said body with said through openings thereof out of alignment with said slots.

2. The electrical connector of claim 1 in the form of an electrical cube tap comprising a molded body bearing at one of its ends an electrical cord of a pair of electrical conductors.

3. The electrical cube tap of claim 2 provided with a plurality of pairs of parallel, prong-receiving slots.

4. The electrical cube tap of claim 3 provided with two pairs of said slots and with said protective plate associated with one of said pairs of slots.

5. The electrical cube tap of claim 3 bearing at least three pairs of prong-receiving slots with said protective plate associated with two of said three pairs of slots.

6. The electrical cube tap of claim 2 wherein said molded body bears a lip overlying at least one edge of said cavity and said remaining leg of said spring member is retained beneath said lip.

7. The electrical cube tap of claim 6 wherein the remaining leg of said resilient spring member is generally U-shaped to provide an outwardly dependent upper end bearing against the undersurface of said lip.

8. The electrical cube tap of claim 6 wherein said spring member is formed of an acetal copolymer.

9. The electrical cube tap of claim 2 wherein said cavity comprises a central longitudinal cavity open at the end opposite said conductor bearing end and extending a substantial length of said body.

10. An electrical cube tap comprising:

a one-piece, molded body of resilient material bearing at least two pairs of parallel, prong-receiving slots longitudinally aligned along an exterior surface;

an embedded pair of longitudinal and parallel electrical conductor strips, one each underlying longitudinally aligned slots of said pairs of slots and bearing prong-receiving slits, one each in a prong-receiving position within each of said slots;

an electrical cord received at one end of said body with separate electrical conductors, one each in engagement with a separate one of said parallel electrical conductor strips;

a groove extending transversely across said exterior surface of said body and intersecting a first pair of said pairs of slots;

a cavity in said body, open to said groove centrally between said first pair of prong-receiving slots; and a protective plate member seated for sliding movement in said groove and bearing: (1) a pair of parallel, through openings for registration with the underlying first pair of slots; and (2) a bifurcated spring member projecting from its inboard surface into said cavity and operative to bias said plate member transversely of said body, thereby positioning said parallel through openings out of registration with said first pair of slots.

11. The cube tap of claim 10 bearing an additional pair of prong-receiving slots in an exterior surface opposite to that bearing said at least two pairs of slots with a second transverse groove, cavity and plate means associated with a second pair of said slots.

12. The cube tap of claim 11 wherein said central cavity extends longitudinally into said body from its end opposite its cord-receiving end.

* * * * *